US009016657B2

(12) United States Patent
Fang et al.

(10) Patent No.: US 9,016,657 B2
(45) Date of Patent: Apr. 28, 2015

(54) MACHINE AND FIXED CONNECTION OF OPERATING SPACE FRAME FOR THE SAME

(75) Inventors: Liang Fang, Wuxi (CN); Xiangchang Wu, Wuxi (CN)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 222 days.

(21) Appl. No.: 13/480,249

(22) Filed: May 24, 2012

(65) Prior Publication Data

US 2012/0298834 A1 Nov. 29, 2012

(30) Foreign Application Priority Data

May 27, 2011 (CN) ..... 2011 2 0182308 U

(51) Int. Cl.
*F16M 13/00* (2006.01)
*E02F 9/16* (2006.01)

(52) U.S. Cl.
CPC ..... *E02F 9/166* (2013.01); *E02F 9/163* (2013.01); *E01C 2301/30* (2013.01)

(58) Field of Classification Search
USPC ..... 248/637, 638, 672, 673, 676, 678
See application file for complete search history.

(56) References Cited

U.S. PATENT DOCUMENTS 5,306,121 A * 4/1994 Heflin et al. ..... 417/363
5,524,860 A * 6/1996 Ives ..... 248/674
5,644,991 A * 7/1997 Prevot et al. ..... 108/54.1
6,336,794 B1 * 1/2002 Kim ..... 417/363
7,921,679 B2 * 4/2011 Jo ..... 68/3 R
8,113,603 B2 * 2/2012 Park et al. ..... 312/228
2003/0071187 A1 * 4/2003 Herren et al. ..... 248/638
2007/0102618 A1 * 5/2007 Hunke et al. ..... 248/673

FOREIGN PATENT DOCUMENTS

| | | |
|---|---|---|
| CN | 101695942 | 4/2010 |
| CN | 202225928 | 5/2012 |
| CN | 103738420 | 12/2013 |
| JP | 2004189089 | 7/2004 |

* cited by examiner

*Primary Examiner* — Steven Marsh
(74) *Attorney, Agent, or Firm* — Finnegan, Henderson, Farabow, Garrett & Dunner, LLP

(57) ABSTRACT

The present disclosure discloses a fixed connection of an operating space frame of a machine, comprising: a machine frame; an operating space frame mounted on the machine frame and having a plurality of posts, wherein a first connecting plate is fixedly connected respectively at a lower portion of at least two adjacent posts, the first mounting plate is fixedly connected to the machine frame via a connecting member, and a stopper is provided between the first mounting plate and the machine frame. The fixed connection improves the connection strength between the operating space frame and the machine so as to suppress deformation of the operating space frame subjected to an impact of an external force and thus provide protection for the operator and equipments therein. The present disclosure further relates to a machine having the above fixed connection.

13 Claims, 2 Drawing Sheets

MACHINE AND FIXED CONNECTION OF OPERATING SPACE FRAME FOR THE SAME

TECHNICAL FIELD

The present disclosure relates to a fixed connection of a machine, and particularly to a fixed connection of an operating space frame for a machine. The present disclosure further relates to a machine having the fixed connection.

BACKGROUND

Machines such as engineering machines are extensively applied in industries such as mining, architecture and agriculture, and these machines may include various machines such as road rollers, loaders, excavators, backhoes, bulldozers and graders. These machines are usually provided with an operating space for receiving a work station and an operator of the machine. The operating space is protected by a frame, for example, an open-type operating space having an operating space frame, or a closed operating space formed by covering the operating space with covering articles such as a cover panel and glass so as to form a closed cab. The operating space frame is usually fixedly connected to a machine, e.g., connected to a machine frame of the machine.

Machines generate vibration during operation and sometimes are subjected to an impact of various external forces. This requires the operating space frame of the open-type operating space or the frame structure of a cab to have a high strength. For example, machines might roll over upon travelling or operation because of terrible terrain conditions or might be subjected to an impact of a falling object such as a rock. In order to prevent the operating space frame from deformation when being subjected to the impact of an external force, there is a requirement to further improve the strength of the operating space frame, particularly, the strength at a position where the operating space frame is connected to the machine to keep an operator in the operating space safe and avoid damages to equipments in the operating space.

Accordingly, the present disclosure aims to address one or more of the above problems.

SUMMARY

In one aspect, the present disclosure provides a fixed connection of an operating space frame for a machine, comprising a machine frame; an operating space frame mounted on the machine frame and having a plurality of posts, wherein a first connecting plate is fixedly connected respectively at a lower portion of at least two adjacent posts, the first mounting plate is fixedly connected to the machine frame via a connecting member, and a stoppers is provided between the first mounting plate and the machine frame.

According to an embodiment, the fixed connection further comprises a second mounting plate, wherein the stopper is provided between the first mounting plate and the second mounting plate, the second mounting plate is detachably connected to the machine frame, and the first mounting plate is fixedly connected to the second mounting plate via the connecting member.

In an embodiment, the fixed connection further comprises a floor fixed on the machine frame, the stoppers is disposed between the first mounting plate and the floor, and the first mounting plate is fixedly connected to the floor via the connecting member.

According to an embodiment, the stopper is disposed at a position adjacent to the connecting member.

According to an embodiment, the connecting member is a resilient connecting member.

According to an embodiment, the second mounting plate is provided with a boss in which a threaded hole for receiving a bolt of the connecting member is formed.

In another aspect, the present disclosure provides a machine, comprising a machine frame; an operating space frame mounted on the machine frame and having a plurality of posts, wherein a first connecting plate is fixedly connected respectively at a lower portion of at least two adjacent posts, the first mounting plate is fixedly connected to the machine frame via a connecting member, and a stopper is provided between the first mounting plate and the machine frame.

According to an embodiment, the machine further comprises a second mounting plate, wherein the stoppers is provided between the first mounting plate and the second mounting plate, the second mounting plate is detachably connected to the machine frame, and the first mounting plate is fixedly connected to the second mounting plate via the connecting member.

According to the embodiment, the machine further comprises a floor fixed on the machine frame, wherein the stoppers are disposed between the first mounting plate and the floor, and the first mounting plate is fixedly connected to the floor via the connecting member. Preferably, the stopper is disposed at a position adjacent to the connecting member.

The fixed connection according to the present disclosure, by providing a stopper between the first mounting plate and the floor, improves the connection rigidity between the cab and the machine frame, particularly enhances the strength at the connection position between the operating space frame and the floor, thereby avoiding the cab from serious deformation when subjected to an impact of an external force for example in the event of roll over of the machine, and protecting the operator or equipments in the operating space frame from injury

BRIEF DESCRIPTION OF THE DRAWINGS

Other features and advantages of the present disclosure will be made more apparent by the following description of exemplary but not-limiting embodiments with reference to the following figures.

DETAILED DESCRIPTION

Exemplary embodiments of the present disclosure will be described in detail with reference to figures, wherein like reference number denotes like element. It is appreciated that the figures are not necessarily drawn in scale for illustration purpose.

Figure 1:
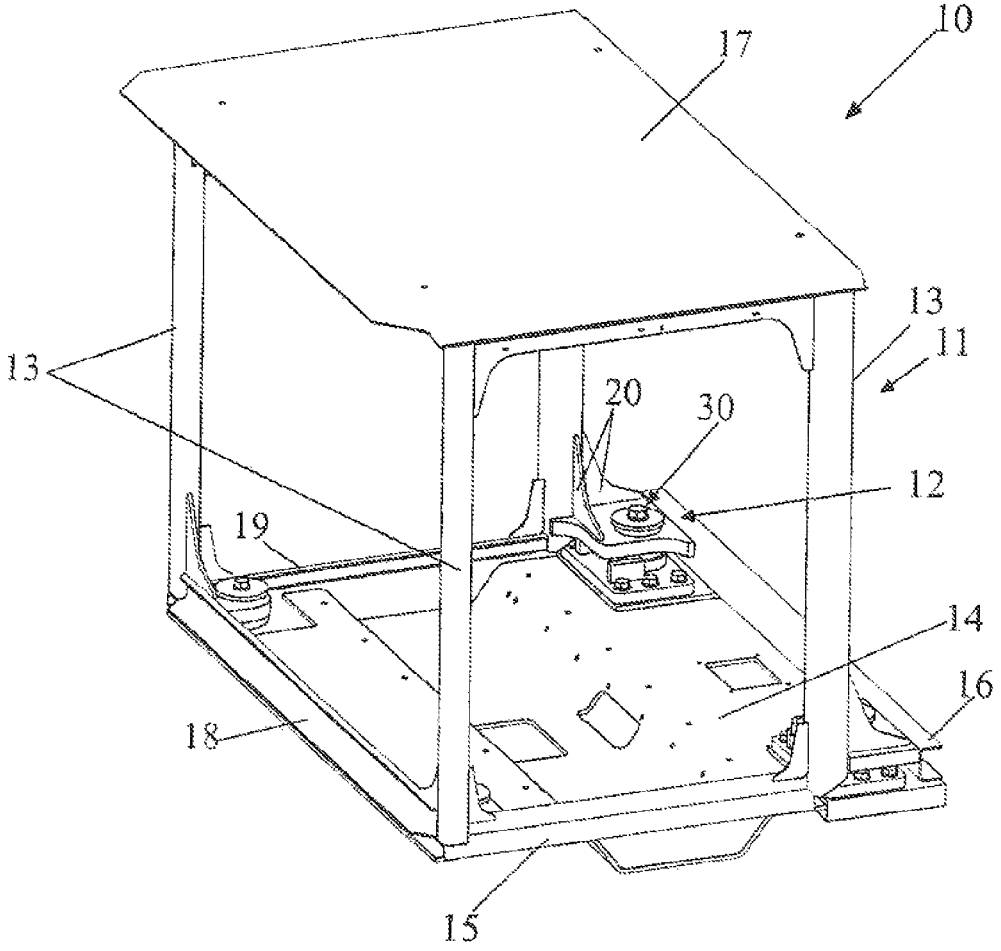
FIG. 1 illustrates a perspective view of an operating space frame for a machine according to an embodiment of the present disclosure.

Referring to FIG. 1, there is disclosed a cab 10 mounted on a machine such as a paving machine to form an operating space, the cab 10 having an operating space frame 11 to receive a work station and an operator. The cab 10 is a closed structure. In FIG. 1, covering objects such as a cover panel and glass are removed from the operating space frame 11 so that the structure of the operating space frame appears clearer. The machine may not be mounted with the cab 10 forming the closed operating space, and it can employ an open-type operating space. The open-type operating space has a protective operating space frame 11, for example, in hot regions or seasons, the machine is not provided with a closed cab, but only with the operating space frame 11 having a sunshade top wall 17. The operating space frame 11 can function to protect the operating space.

Further referring to FIG. 1, the cab 10 comprises the operating space frame 11. The operating space frame 11 of the cab 10 comprises a plurality of posts such as tubular posts 13, and lower frames 15, 16, 18, 19 and upper frames (not shown) having an L-shaped or tubular cross section. The posts are usually welded together to form the operating space frame 11 of the cab having a certain strength. A top panel and side walls can be mounted between these posts to form a closed cab 10 with a door and windows. A cab floor 14 is fixedly connected to an upper portion of a machine frame (not shown), and the floor 14 can also form a part of the cab 10. In other words, a part of the machine frame can form the floor 14, or an independent floor can be formed individually for the operating space such as the cab 10 and the operating space frame 11 can be directly mounted on the machine frame. Although not shown in the figures, those skilled in the art can readily appreciate that additional devices such as a door can be disposed on the cab 10.

Figure 2:
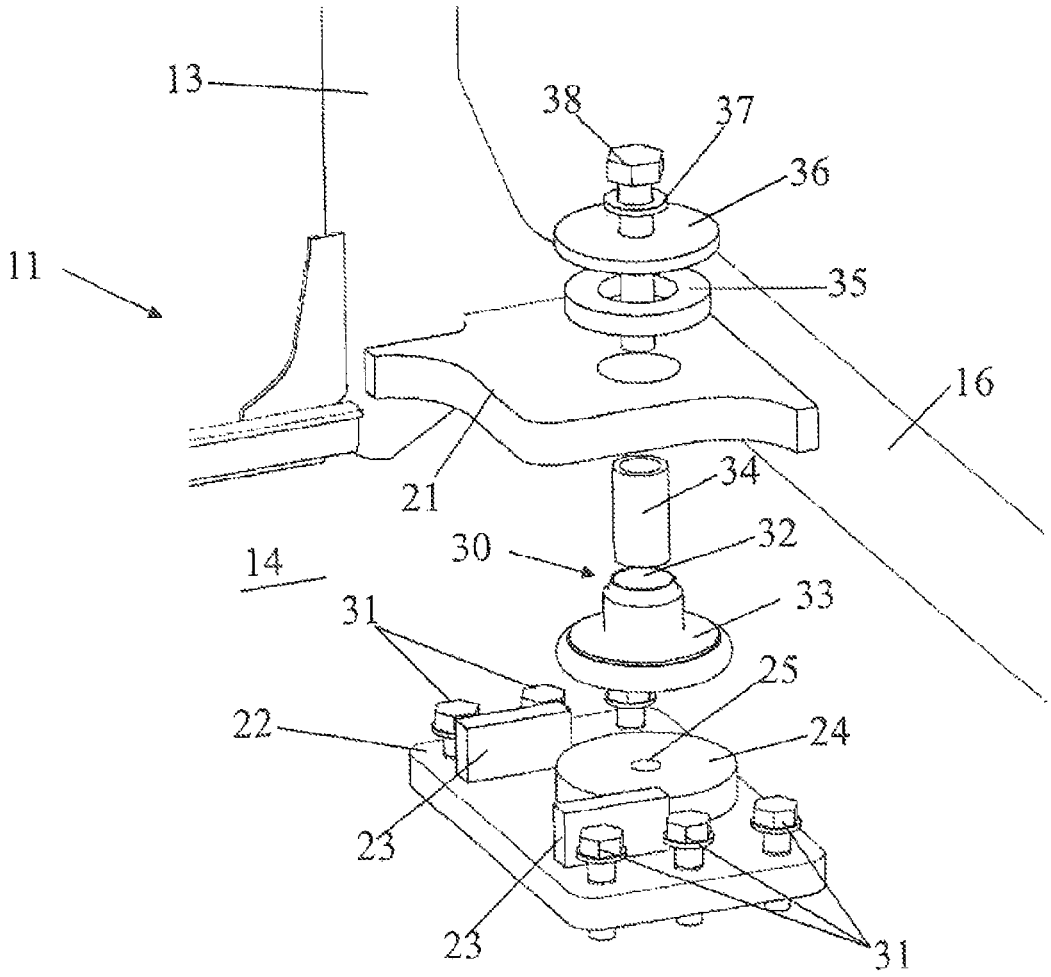
FIG. 2 is an exploded view of a fixed connection position of the operating space frame of FIG. 1, showing a connection structure of the operating space frame and the machine.

Again as shown in FIG. 1, the operating space frame 11 of the cab 10 is connected to the floor 14 via a connection 12. The operating space frame 11 is fixed to the floor 14 via the connection 12 so as to fix the cab 10 as a whole on the machine. As shown in FIG. 2, the connection 12 comprises a first mounting plate 21 fixedly connected to the post 13 at a certain distance from a bottom end of the post 13, a second mounting plate 22 detachably connected to the floor 14, and a resilient connecting member 30. A gusset plate 20 (as shown in FIG. 1) is fixedly connected between the first mounting plate 21 and the post 13 to make the connection between the post 13 and the first mounting plate 21 firmer. The resilient connecting member 30 fixedly connects the first mounting plate 21 and the second mounting plate 22 so as to fixedly connect the cab to the floor 14. Specifically, one side of the first mounting plate 21 may be welded to a bottom portion of the post 13, and the other side can be welded to the lower frame 16. The second mounting plate 22 is a separate structure detachable from the floor 14 and can be provided with a plurality of threaded holes through which a plurality of bolts 31 can pass to fixedly connect the second mounting plate 22 to the floor 14. A boss-shaped connecting plate 24 is fixedly connected, for example, welded to the second mounting plate 22, to the second mounting plate 22, and a connecting threaded hole 25 is formed in the middle of the connecting plate 24. The first mounting plate 21 of the operating space frame 11 can also be directly fixedly connected to the floor 14 via the resilient connecting member 30 without the second mounting plate 22. Therefore, it can be appreciated that the floor 14 may be formed with connecting threaded holes 25 and the connecting plate 24 is omitted.

Again as shown in FIG. 2, the resilient connecting member 30 comprises a disc-shaped resilient hollow tubular member 33 provided between the first mounting plate 21 and the second mounting plate 22 with a boss in the middle, and the tubular member 33 is made of a resilient material such as rubber. A rigid tube 34 is mounted in a mouth 32 of the tubular member 33. The resilient connecting member 30 further comprises a resilient washer 35, a gasket 36 and a washer 37 disposed above the first mounting plate 21. The resilient connecting member 30 further comprises a bolt 38 running through the hollow portion of the above members and finally fastened with the connecting threaded hole 25 at a center of the boss-shaped connecting plate 24. The resilient washer 35 in the resilient connecting member 30 and the disc-shaped resilient hollow tubular member 33 having a boss in the middle ensure resilient connection between the operating space frame 11 of the cab 10 and the floor 14 and reduce the vibration of the cab 10 and damp noise during operation of the machine.

Two stoppers 24 are welded on an upper surface of the second mounting plate 22 substantially parallel to each other. The stoppers 23 are located between the first mounting plate 21 and the second mounting plate 22 and at a position adjacent to the resilient connecting member 30. It should be appreciated that a height of the stopper 23 is less than a distance between the first mounting plate 21 and the second mounting plate 22 to form a space between the stopper 23 and the first mounting plate 21 so that a deformation space for the resilient connecting member 30 is left to damp vibration of the cab 10 when vibration is generated upon operation of the machine. It can also be appreciated that the stopper 23 can be one or more than two stoppers and can be provided on the first mounting plate 21.

INDUSTRIAL APPLICABILITY

The connection according to the present disclosure can be used for machines for example including but not limited to paving machines, bulldozers, graders and excavators, etc.

When the cab 10 is mounted, first the second mounting plate 22 is fixedly connected to the floor 14 via the bolt 31, then the duly-assembled resilient hollow tubular member 33 and the rigid tube 34 are disposed between the first mounting plate 21 and the second mounting plate 22, finally the first mounting plate 21 is fixedly connected to the second mounting plate 22 via the bolt 38 so as to fixedly connect the operating space frame 11 to the floor 14, and the cab 10 is finally mounted on the machine.

The resilient connecting member 30 can reduce vibration of the cab 10 upon operation of the machine, but the strength at the connection position of the resilient connecting member 30 is relatively weak. When the operating space frame 11 is subjected to an impact of an external force, e.g., impact of a falling object or in the event of roll over of the machine, the connecting bolt 38 of the resilient connecting member 30 is liable to deform due to the impact of the external force. In the present disclosure, the stoppers 23 are disposed at a position close to the resilient connecting member 30. When the operating space frame 11 deforms upon impact of the external force, causing the posts 23 to incline, the first connecting plate 21 fixedly connected to the post 13 contacts with the stoppers 23, and the stoppers 23 function to support the first mounting plate 21, thereby increasing the strength at the connection position between the operating space frame 11 and the floor 14, and preventing the overall deformation of the operating space frame 11. As such, the operator and equipments in the operating space frame 11 can be protected.

In specific applications, the connection 12 is disposed at least at the lower portions of the two posts 13 in the rear part of the cab 10. However, the connection can also be disposed at all of the lower portions of four posts.

Although described by way of exemplary embodiments, the present disclosure is not limited to the details described as above. Hence, various modifications and variations to the present disclosure that can be made by those skilled in the art all fall within the scope of the present disclosure.

What is claimed is:

1. A fixed connection for connecting an operating space frame to a machine frame; the fixed connection comprising:
a first mounting plate fixedly connectable to a lower portion of the operating space frame;
a second mounting plate detachably connected to the machine frame;
a connecting member fixedly connected to the first mounting plate and configured to fixedly connect the first mounting plate to the the second mounting plate; and
a stopper connected to the second mounting plate and disposed between the first mounting plate and the second mounting plate, such that there is a gap between the first mounting plate and the stopper.

2. The fixed connection according to claim 1, wherein the machine frame includes a floor and the second mounting plate is detachably connected to the floor.

3. The fixed connection according to claim 1, wherein the stopper is disposed at a position adjacent to the connecting member.

4. The fixed connection according to claim 1, wherein the connecting member is a resilient connecting member.

5. The fixed connection according to claim 1, wherein the second mounting plate is provided with a boss including a threaded hole for receiving a bolt of the connecting member.

6. A machine, comprising:
a machine frame;
an operating space frame having a plurality of posts; and
a fixed connection connecting the operating space frame to the machine frame, the fixed connection including:
a first mounting plate fixedly connected at a lower portion of at least one of the plurality of posts;
a connecting member fixedly connecting the first mounting plate to the machine frame; and
a stopper connectable to the machine frame and disposed between the first mounting plate and the machine frame, such that there is gap between the first mounting plate and the stopper.

7. The machine according to claim 6, further comprising a second mounting plate detachably connected to the machine frame, wherein:
the connecting member connects the first mounting plate to the second mounting plate; and
the stopper is connected to the second mounting plate.

8. The machine according to claim 6, further comprising a floor fixed on the machine frame, wherein the stopper is disposed between the first mounting plate and the floor, and the first mounting plate is fixedly connected to the floor via the connecting member.

9. The machine according to claim 7, wherein the stopper is disposed at a position adjacent to the connecting member.

10. The fixed connection according to claim 1, further including:
a connecting plate connected to the second mounting plate such that the stopper is disposed adjacent to the connecting plate.

11. The fixed connection according to claim 10, wherein the connecting plate further includes a threaded hole and the first mounting plate is connected to the connecting plate via the threaded hole.

12. The fixed connection according to claim 10, wherein the connecting member further includes:
a disc-shaped member; and
a tubular member mounted at a first end of the disc-shaped member.

13. The fixed connection according to claim 12, wherein the disc-shaped member comprises:
a tubular upper portion having a first diameter; and
a disc-shaped lower portion having a second diameter larger than the first diameter.

* * * * *

UNITED STATES PATENT AND TRADEMARK OFFICE

CERTIFICATE OF CORRECTION

PATENT NO. : 9,016,657 B2
APPLICATION NO. : 13/480249
DATED : April 28, 2015
INVENTOR(S) : Fang et al.

It is certified that error appears in the above-identified patent and that said Letters Patent is hereby corrected as shown below:

Specification

Column 2, line 38, delete "injury" and insert -- injury. --.

Claims

Column 5, line 3, In claim 1, delete "frame;" and insert -- frame, --.

Column 5, line 10 (Approx.), In claim 1, delete "the the" and insert -- the --.

Signed and Sealed this
Nineteenth Day of April, 2016

Michelle K. Lee

Michelle K. Lee
*Director of the United States Patent and Trademark Office*